US005331300A

United States Patent [19]

Shimizu et al.

[11] Patent Number: 5,331,300

[45] Date of Patent: Jul. 19, 1994

[54] DIELECTRIC FILTER DEVICE

[75] Inventors: Hiroyuki Shimizu; Kenji Ito, both of Nagoya, Japan

[73] Assignee: NGK Spark Plug Co. Ltd., Aichi, Japan

[21] Appl. No.: 51,789

[22] Filed: Apr. 26, 1993

[30] Foreign Application Priority Data

Apr. 30, 1992 [JP] Japan ..... 4-139867

[51] Int. Cl.[5] ..... H01P 1/203; H01P 1/205

[52] U.S. Cl. ..... 333/202; 333/204; 333/206

[58] Field of Search ..... 333/202-205, 333/206, 207, 219

[56] References Cited

U.S. PATENT DOCUMENTS 4,703,291 10/1987 Nishikawa et al. ..... 333/202
4,785,271 11/1988 Higgins, Jr. ..... 333/204

FOREIGN PATENT DOCUMENTS 2142214 2/1973 Fed. Rep. of Germany .
0156902 7/1986 Japan ..... 333/206
0131601 7/1988 Japan ..... 333/204
0109902 4/1989 Japan ..... 333/202
3-136502 6/1991 Japan .
4312002 11/1992 Japan ..... 333/204

OTHER PUBLICATIONS

Patent Abstracts of Japan, vol. 11, No. 33, 30 Jan. 1987, JP-A-61 201 501.
Patent Abstracts of Japan, vol. 8, No. 63, 24 Mar. 1984, JP-A-58 213 503.
Patent Abstracts of Japan, vol. 14, No. 213, 7 May 1990, JP-A-20 50 502.

*Primary Examiner*—Seungsook Ham
*Attorney, Agent, or Firm*—Larson and Taylor

[57] ABSTRACT

A dielectric filter device including a stripline filter having a plurality of strip-shaped resonance conductors on its upper surface, and a plurality of dielectric blocks each having a groove coated with conductive layer on the stripline filter, wherein the height of the arrangement can be reduced as compared with any conventional block type filter devices, and can be given a higher Q value than stripline filter devices.

5 Claims, 3 Drawing Sheets

DIELECTRIC FILTER DEVICE

BACKGROUND OF THE INVENTION

The present invention relates to a dielectric filter device having a stripline filter and dielectric blocks.

FIG. 1 discloses a dielectric filter device in a prior art wherein it comprises a plurality of juxtaposed dielectric coaxial resonators each of which includes a rectangular parallelepiped dielectric block A. Each dielectric block A is provided with a groove B having circular cross section and extended in the center axial direction, and an external conductive layer C on an outer surface except a front surface thereof. The groove B in each dielectric block A has the inner surface coated with a conductive layer D. An example of such a filter arrangement is disclosed in Japanese Patent Kokai No. 3-136502.

Such a conventional filter arrangement has a disadvantage in that it is larger in height because each of the juxtaposed dielectric coaxial resonators comprises the rectangular parallelepiped dielectric block. Therefore, it does not substantially meet a requirement for a size reduction of potable communication equipments such as potable telephones incorporating such a filter device.

On the other hand, as a filter device for use with such potable communication equipments there is also known a stripline filter in which resonator conductors are arranged on a dielectric substrate. The stripline filter permits a reduction in thickness but shows a low Q value and thus a large insertion loss is to be involved.

SUMMARY OF THE INVENTION

It is therefore an object of the present invention to provide a dielectric filter device capable of overcoming the problems or disadvantages of the conventional filter arrangements, and having a low insertion loss.

According to the present invention, there is provided a dielectric filter device comprising a stripline filter which comprises a thin dielectric substrate provided with a plurality of resonance conductors on the upper surface and a ground conductor at least on the main portion of the outer surface other than said upper surface, said resonance conductors being arranged to form a predetermined pattern and each having one end connected to said ground conductor, and a plurality of dielectric blocks each being provided with a ground conductor at least on the main portion of the outer surface and a downwardly open groove on the inner surface of which an inner conductive layer is formed, said dielectric blocks being mounted on the upper surface of said stripline filter so that each dielectric block is positioned on the associated resonance conductor of said stripline filter, the inner conductive layer being connected with the associated resonance conductor of said stripline filter.

Preferably, the stripline filter may be made thiner than the respective dielectric blocks of the present invention.

Also in the dielectric filter device of the present invention, a spacer may be additionally provided between the adjacent dielectric blocks mounted on the stripline filter for adjusting a magnetic coupling therebetween.

By connecting the resonance conductors of the stripline filter located on both the outermost sides thereof to input and output terminals, respectively, an electrical coupling occurs between the inner conductive layers of the adjacent dielectric blocks and between the resonance conductors of the stripline filter, thereby performing a filteration of a required frequency bandwidth.

The dielectric filter device of the present invention can be made thinner than the conventional arrangement with dielectric blocks but can be given a desired resonator Q value by changing the dielectric blocks in thickness.

The present invention will now be described by way of example with reference to the accompanying drawings:

DETAILED DESCRIPTION

Figure 1:
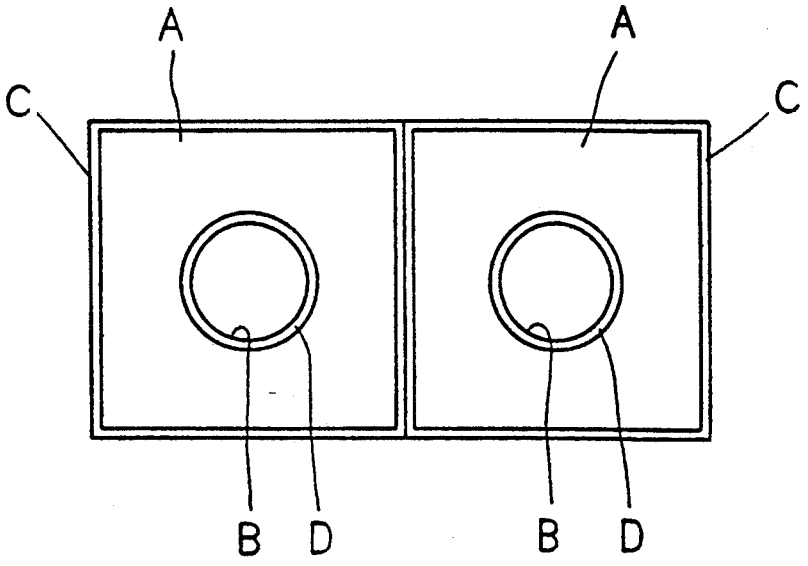
FIG. 1 PRIOR ART
FIG. 1 is a front view showing a conventional dielectric block filter device.
Figure 2:
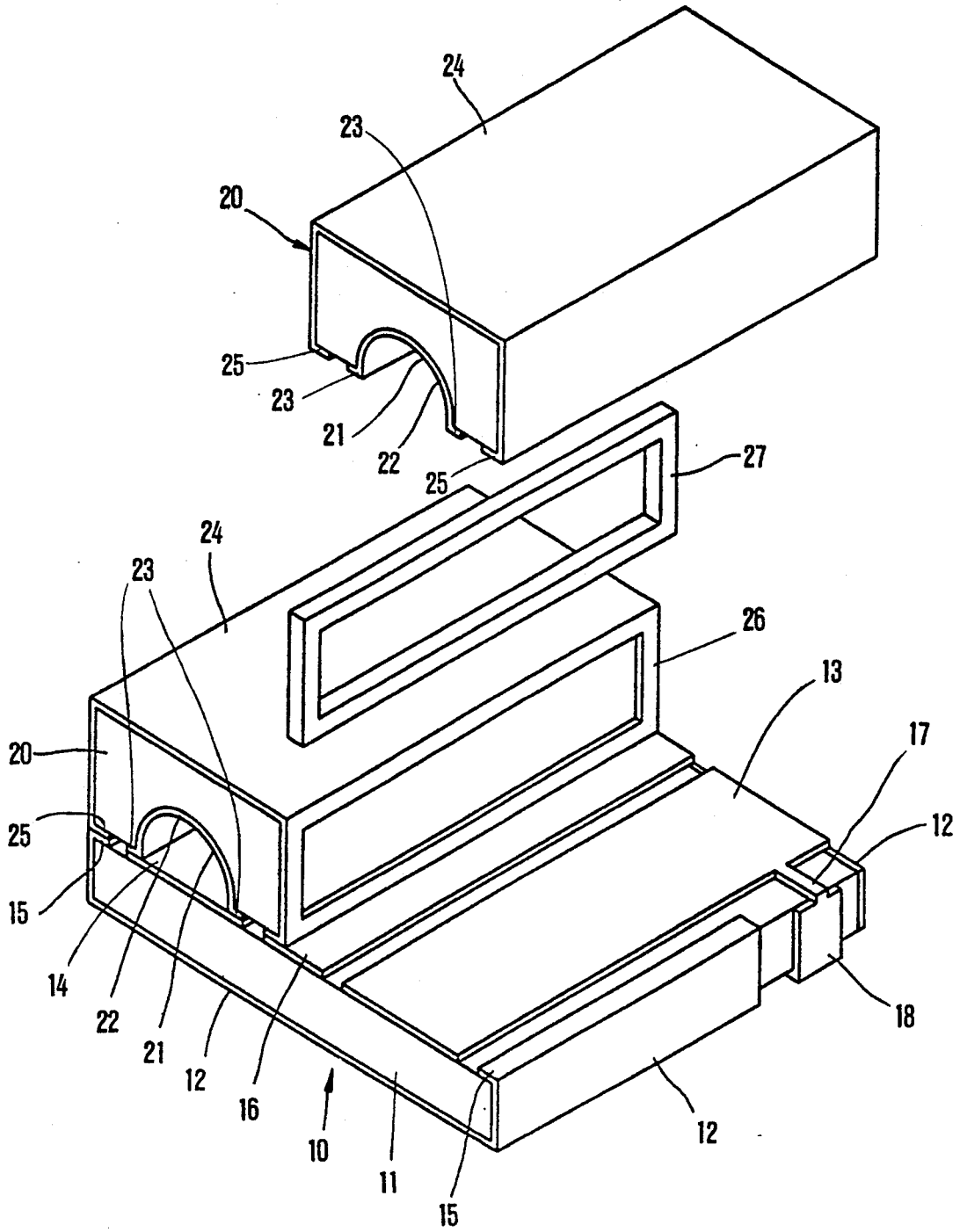
FIG. 2 is a partially exploded perspective view of a dielectric filter device according to the present invention.
Figure 3:
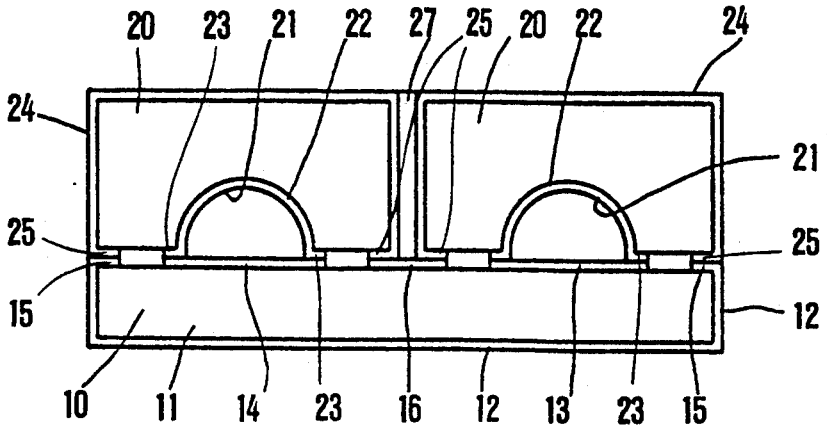
FIG. 3 is a schematic front view showing the dielectric filter device of FIG. 2 when being assembled.

Referring to FIGS. 2 and 3, there is shown a dielectric filter device according to an embodiment of the present invention, which comprises a stripline filter 10 and two dielectric blocks 20.

The stripline filter 10 includes a thin dielectric substrate 11 made of titanium oxide dielectric ceramic material, and has a thickness thinner than that of the dielectric blocks 20 as shown in FIG. 3. A ground conductor 12 is formed on the substantial portion of the outer surface of the substrate 11 which is exposed to the atmosphere when being assembled except the front surface thereof. A plurality of (two in the illustrated arrangement) strip-shaped resonance conductors 13 and 14 are formed on the upper surface of the substate 11 so as to form a predetermined pattern. Rear ends of the resonance conductors 13 and 14 are connected with the ground conductor 12 to form short-circuit terminals, while front ends of the the resonance conductors 13 and 14 are terminated at the same level as the front edge of the substrate to form open-circuit terminals. Also on the upper surface of the dielectric substrate 11 edge conductors 15 are partially formed along the lateral edge portion thereof and an intermediate conductor 16 is formed between the resonance conductors 13 and 14 in parallel therewith. The edge conductors 15 and the intermediate conductor 16 are connected with the ground conductor 12.

Alternately, the intermediate conductor 16 may be formed partly or may be omitted.

As will be seen, each of the resonance conductors 13 and 14 has a lateral extension 17 electrically connected with input and output terminals (only one is shown by reference numeral 18) which are provided on the the lateral outer surfaces of the substrate 11, are electrically separated from the ground conductor 12, and are connected with external conducting wires (not shown).

Similarly, each of the dielectric blocks 20 is made of titanium oxide dielectric ceramic material, and is of a rectangular parallelepiped. Each dielectric block 20 is formed with a downwardly open groove 21 of a semicircular cross section which is extended along a longitudinal direction thereof. The groove 21 has an inner surface formed with an inner conductive layer 22 which is extended to the edge portions of the groove 21 as shown by 23 in FIGS. 2 and 3. Also, each dielectric block 20 is formed with a ground conductor 24 on the upper and lateral surfaces except the front and bottom surfaces thereof. Along the lateral and rear edge portions of the bottom surface of each dielectric block 20 there are formed edge conductors 25 which are connected with the ground conductor 24. As will be seen in FIG. 2, each of the lateral surfaces of the dielectric blocks 20 which are opposite to each other is formed with a conductor 26 only on the peripheral edge portion thereof. The conductor 26 is connected with the ground conductor 24.

The dielectric blocks 20 are mounted on the strip-shaped resonance conductors 13 and 14 of the stripline filter 10, and each of the inner conductive layers 22 in the dielectric blocks 20 is electrically connected with the corresponding resonance conductor 13 or 14 via the edge conductive conductor portions 23. Then a spacer frame 27 is interposed between the dielectric blocks 20 for forming a gap therebetween. The spacer frame 27 is used for adjusting a magnetic coupling between the adjacent dielectric blocks 20. That is, if the degree or quantity of the coupling between the resonance conductors 13 and 14 is stronger, their resonance bandwidth becomes too wide. By provision of the spacer frame 27 it is possible to reduce the degree of the coupling between the resonance conductors 13 and 14. Similar adjustment is possible even by providing a dielectric layer having a smaller dielectric constant than that of the dielectric blocks 20 instead of the spacer frame 27, or by forming an edge conductor connected with the ground conductor 24 on the lateral surfaces adjacent to each other of the dielectric blocks 20.

When the dielectric blocks 20 are mounted on the stripline filter 10, the input and output terminals 18 on both sides or lateral surfaces of the stripline filter 10 are electrically connected with the inner conductive layers 22 through the strip-shaped resonance conductors 13 and 14, respectively. Therefore, between the inner conductive layers 22 of the adjacent dielectric blocks 20 and between the strip-shaped resonance conductors 13 and 14 there are obtained electrical couplings which result in a filtering of the desired frequency bandwidth.

With the illustrated embodiment, the input and output terminals 18 are provided on the stripline filter 10 for the external connection. However, for this end, connecting terminals may be inserted into the grooves of the dielectric blocks 20. In that case, the coupling capacitance may be changed by adjusting the insertion depth of the connecting terminals into the grooves.

Furthermore, the dielectric filter may be constructed by providing more than three strip-shaped resonance conductors on the dielectric substrate and the same number of dielectric blocks which are mounted on the substrate. The present invention may be carried out as a comb type arrangement in which the open-circuit or short-circuit ends of the respective resonance conductors are aligned with each other, or an interdegitated type arrangement in which the respective resonance conductors are alternately directed.

Figure 4:
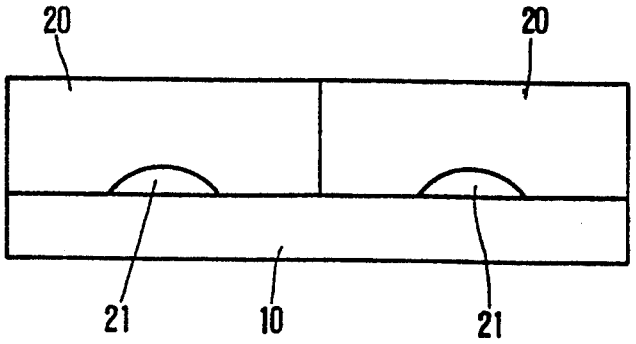
FIGS. 4(*a*) and 4(*b*) are schematic front view showing modifications of the dielectric filter device according to the present invention.
Figure 4:
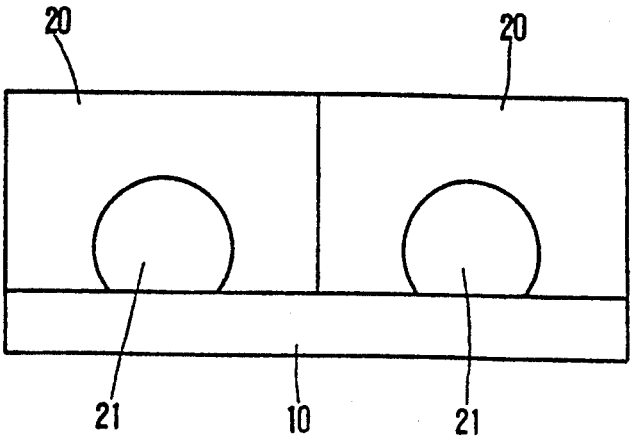

With the illustrated filter device, the dielectric blocks may be modified as shown in FIG. 4(*a*) and 4(*b*). In an arrangement illustrated in FIG. 4(*a*) each dielectric block is made thinner and is provided with a shallow groove. In the case of FIG. 4(*b*) each dielectric block is provided with a deep groove.

As described above, according to the present invention with the provision of a plurality of dielectric blocks each having a groove coated with conductive layer on the stripline filter having a plurality of strip-shaped resonance conductors on its upper surface, the height of the arrangement can be reduced as compared with any conventional block type filter devices. Therefore, the present invention can provide a dielectric filter device which fully meets with the requirement for smaller and thinner dimensions of the potable communication equipments. Also, the provision of a plurality of dielectric blocks each having a groove coated with conductive layer on the stripline filter can be given a higher Q value than stripline filter devices.

It is to be understood that the above-mentioned embodiments are only illustrative of the application of the principles of the present invention. Numerous modifications and alterations may be made by those skilled in the art without departing from the spirit and scope of the invention, and the appended claims are intended to cover such modifications and alterations.

We claim:

1. A dielectric filter device comprising:

a stripline filter which includes a thin dielectric substrate provided with a plurality of resonance conductors on an upper surface and a first ground conductor at least on a main portion of an outer surface other than said upper surface, said resonance conductors being arranged to form a predetermined pattern and each said resonance conductor having one end connected to said first ground conductor; and a plurality of dielectric blocks which are thicker than said stripline filter, each said dielectric block being provided with a second ground conductor at least on a main portion of an outer surface, a downwardly open groove on an inner surface, and an inner conductive layer formed on said inner surface such that each said dielectric block is positioned on an associated said resonance conductor of said stripline filter with said inner conductive layer of each said dielectric block being connected with the associated said resonance conductor of said stripline filter.

2. A dielectric filter device comprising:

a stripline filter which includes a thin dielectric substrate provided with a plurality of resonance conductors on an upper surface, an intermediate conductor arranged between adjacent said resonance conductors and in parallel therewith, and a first ground conductor at least on a main portion of an outer surface other than said upper surface, said resonance conductors being arranged to form a predetermined pattern and each said resonance conductor having one end connected to said first ground conductor;

a plurality of dielectric blocks each being provided with a second ground conductor at least on a main portion of an outer surface, a downwardly open groove on an inner surface, and an inner conductive layer formed on said inner surface such that each said dielectric block is positioned on an associated said resonance conductor of said stripline filter with said inner conductive layer of each said dielectric block being connected with the associated said resonance conductor of said stripline filter and with said second ground conductors of adjacent said dielectric blocks connected with said intermediate conductor.

3. A dielectric filter device comprising:

a stripline filter which includes a thin dielectric substrate provided with a plurality of resonance conductors on an upper surface and a first ground conductor at least on a main portion of an outer surface other than said upper surface, said resonance conductors being arranged to form a predetermined pattern and each said resonance conductor having one end connected to said first ground conductor;

a plurality of dielectric blocks each being provided with a second ground conductor at least on a main portion of an outer surface, a downwardly open groove on an inner surface, and an inner conductive layer formed on said inner surface such that each said dielectric block is positioned on an associated said resonance conductor of said stripline filter with said inner conductive layer of each said dielectric block being connected with the associated said resonance conductor of said stripline filter; and a spacer which is provided between said adjacent dielectric blocks mounted on said stripline filter for adjusting a magnetic coupling between said adjacent dielectric blocks.

4. A dielectric filter device as claimed in claim 3, wherein said spacer comprises a frame made of dielectric material which is interposed between opposite lateral surfaces of said adjacent dielectric blocks.

5. A dielectric filter device as claimed in claim 3, wherein said spacer comprises a dielectric layer which is formed on opposite lateral surfaces of said adjacent dielectric blocks.

* * * * *